US009826863B1

(12) United States Patent
Watson

(10) Patent No.: US 9,826,863 B1
(45) Date of Patent: Nov. 28, 2017

(54) MOTORIZED SCRUBBING SYSTEM ATTACHABLE TO A WALL SURFACE

(71) Applicant: Ronald D Watson, Lynn Haven, FL (US)

(72) Inventor: Ronald D Watson, Lynn Haven, FL (US)

( * ) Notice: Subject to any disclaimer, the term of this patent is extended or adjusted under 35 U.S.C. 154(b) by 0 days.

(21) Appl. No.: 15/293,863

(22) Filed: Oct. 14, 2016

(51) Int. Cl.
*A47K 7/04* (2006.01)
*A46B 13/02* (2006.01)
*A47K 7/02* (2006.01)

(52) U.S. Cl.
CPC ..... *A47K 7/04* (2013.01); *A46B 13/02* (2013.01); *A47K 7/024* (2013.01); *A46B 2200/1006* (2013.01)

(58) Field of Classification Search
CPC ..... A47K 7/022; A47K 7/024; A47K 7/04; A46B 13/00; A46B 13/008; A46B 13/02; A46B 13/04; A46B 2200/10; A46B 2200/102; A46B 2200/1006; A61H 7/004
USPC ..... 15/21.1; 4/606; 606/114; D28/63
See application file for complete search history.

(56) References Cited

U.S. PATENT DOCUMENTS 2,730,737 A 1/1956 Herman
3,078,484 A 2/1963 Briggs
3,115,322 A 12/1963 Fleming
3,196,867 A 7/1965 Perry
4,151,623 A 5/1979 Steere
4,228,557 A 10/1980 De Vivo et al.
4,432,113 A 2/1984 Gouge
5,239,712 A 8/1993 Kinder
5,277,389 A 1/1994 Ballares et al.
5,345,640 A 9/1994 Goss
5,382,221 A 1/1995 Hsu et al.
5,450,647 A 9/1995 Dorsey
5,561,869 A 10/1996 Sarel
5,704,903 A 1/1998 Jahnke
5,836,035 A 11/1998 McElfish et al.
D444,916 S 7/2001 Brown, Sr.
D450,158 S 11/2001 Swann
6,343,774 B1 2/2002 Thomas et al.
6,662,386 B1 12/2003 Bowerman
6,732,394 B1 5/2004 Waterman
6,996,861 B1 2/2006 Clark, Jr.
7,120,947 B1 10/2006 Magalianes
7,451,513 B2 11/2008 Torres
8,272,799 B1 * 9/2012 Yard ..... A46B 13/008 15/21.1
8,419,667 B2 4/2013 Chika
(Continued)

FOREIGN PATENT DOCUMENTS

DE 2970798 * 1/1998
FR 3029401 * 6/2016
(Continued)

*Primary Examiner* — Mark Spisich
(74) *Attorney, Agent, or Firm* — Peter Loffler

(57) ABSTRACT

A motorized scrubbing system mounts to an appropriate flat surface via a pair of suction handles attached to a body member of the system. Also attached to the body member is a series of motor assemblies that each have a brush head that is positioned just above a user side of the body member. Each brush head rotates in response to output of a motor associated with the brush head. The user side of the body member is contoured to approximate the contour of a human back.

12 Claims, 3 Drawing Sheets

(56) References Cited

U.S. PATENT DOCUMENTS

| | | | |
|---|---|---|---|
| D699,001 | S | 2/2014 | Kennard, Jr. |
| 8,726,445 | B1 | 5/2014 | Wagner et al. |
| 9,271,614 | B2 | 3/2016 | Rowles |
| 2005/0229347 | A1 | 10/2005 | Dent D'Almuano |
| 2015/0201815 | A1 | 7/2015 | Miller |

FOREIGN PATENT DOCUMENTS

| | | | |
|---|---|---|---|
| GB | 2278052 | * | 11/1994 |
| GB | 2531820 | * | 5/2016 |

* cited by examiner

MOTORIZED SCRUBBING SYSTEM ATTACHABLE TO A WALL SURFACE

BACKGROUND OF THE INVENTION

1. Field of the Invention

The present invention relates to a motorized back scrubbing system that utilizes a series of motors to rotate brush heads to scrub a person's back, the unit removably attachable to a flat surface such as the wall of a shower enclosure.

2. Background of the Prior Art

When a person bathes or showers, their back tends to be a particularly difficult area to clean. Most people simply lack the flexibility to be able to effectively reach all parts of the back and even if all parts can be reached, to apply sufficient pressure with the cleaning implement being used such as a wash cloth, a bar of soap, or simply the person's hands. As a person gets older, this back washing problem becomes exacerbated due to the effects of aging which tends to rob people of some of their flexibility and dexterity so that a clean back becomes even more of a challenge. A person who has suffered an injury, such as a torn rotator cuff or is simply suffering from a shoulder ailment, such as bursitis or a frozen shoulder, finds particular difficulty in the back cleaning process.

One solution that can be employed to effectively clean the back is to simply have an assistant present during bathing or showering so that the assistant can clean the person's back. The assistant can be a spouse or significant other or if the person is disabled another family member or a professional such as a home health care provider. While very effective, an assistant is not a realistic solution to many. Many people live alone and lack the presence of a second person who can assist during bathing and are otherwise healthy and do not need home health care. During travel, especially business travel, many people travel alone so that a spouse or significant other may not be on hand to provide the needed second person. Many people who live in some form of assisted living, desire to maintain as much independence and dignity as possible and do not want to have a person assisting with the rather intimate task of bathing unless necessary.

To address such problems, handheld back brushes have been proposed. A handheld back brush has an elongate handle and a washing or scrubbing implement on a distal end of the handle so that the user grasps the handle of the brush, reaches over the shoulder or around the torso, and uses the implement on the handle for the cleaning process. Back brushes come in a wide variety of styles from the simple to the very complex.

A typical handheld back brush can prove quite effective to a person who has good range of motion in his or her shoulders. Such a person can maneuver the implement end of the brush to their back side for cleaning. However, a person who has limited motion often is unable to effectively maneuver the implement end of the brush around his or her body onto the back. However, even to a person who has appropriate flexibility, the handheld back brush often proves cumbersome to use as the person must maneuver the brush into various positions, often banging into the walls of the bathing enclosure and often employing each hand in turn, in order to effectively get all parts of the back scrubbed clean with the device. In short order, the person's hands get tired of holding and maneuvering the brush, especially if the brush is relatively long and has a relatively heavy implement end.

To address the problems associated with handheld back brushes, non-handheld back brushes have been proposed.

Such devices are brushing or scrubbing elements that are mounted in some fashion to a surface, typically to a wall of the bathing enclosure or other appropriate mounting surface associated with the bathing enclosure. Such non-handheld brushes, which come in a wide variety of architectures, come in one of two broad forms, static and dynamic. A static device has its brushing implement in a fixed position relative to its mount so that once mounted, the brushing element does not move. A dynamic device has its brushing element rotate or otherwise articulate under the control of a motor, such rotation helping with the overall back cleaning process as well as adding an element of soothing comfort. While such devices, either static or dynamic, eliminate the need for a person to hold the brushing element, such devices are not without their own drawbacks. Many devices require alterations to the surface upon which they are to be mounted in order to mount such devices. Many people are not willing or able to make such alterations. Additionally, such devices position the brush element in a single fixed position so that a user must move his or her back up and down and side to side in order for the person's entire back to be cleaned by the device. Such maneuvering by the person may be awkward and difficult, if not impossible to perform, depending on the specific mount configuration and such maneuvering fails to contribute to expected soothing comfort—performing yoga-like maneuvers in a bathtub or shower enclosure may get the person's back clean, but may not prove to be overly fun.

What is needed is a mounted back brush system overcomes the above stated problems found in the art by allowing the system to be mounted at an appropriate location within a bathing enclosure without the need to make permanent alterations to any part of the bathing enclosure. Such a system must require little in the way of effort from the user in using the device to clean the person's entire back. Advantageously, such a system should be of relatively simple design and construction and be easy to use.

SUMMARY OF THE INVENTION

The motorized scrubbing system attachable to a wall surface of the present invention addresses the aforementioned needs in the art by providing a mounted brushing system that allows a person to clean all of his or her back in a bathing enclosure (bathtub, shower enclosure, etc.), without the need to vigorously move about the enclosure while interacting with the device. The present invention cleans the person's back and offers soothing and comforting experience. The motorized scrubbing system attachable to a wall surface mounts quickly and dismounts just as quickly from its wall surface which wall surface includes most surfaces within the enclosure that have appropriate relatively flat portions, including a wall or door of the enclosure or even a portion of the bathtub wall—the device can be mounted to other appropriate surfaces completely independent of the bathing enclosure such as an ordinary door. The motorized scrubbing system attachable to a wall surface is of relatively simple design and construction so as to be relatively inexpensive to produce using standard manufacturing techniques, so as to make the device relatively economical for potential consumers for this type of device.

The motorized scrubbing system attachable to a wall surface of the present invention is comprised of a body member that has a top and a bottom joined by a pair of opposing sides. The body member also has a front surface and a rear surface such that the front surface is contoured to approximate a contour of a typical human back. Such contouring is achieved by forming a channel between the top and the bottom such that the channel rises upwardly in the front surface facing direction in proceeding from the top toward the bottom, reaching a medially disposed crest between the top and the bottom, then curving downwardly to the bottom. A first suction handle is attached to the rear surface of the body member as is second suction handle. A first motor assembly is attached to the rear surface of the body member as is a second motor assembly. The first motor assembly has a first motor therein while the second motor assembly has a second motor therein. A first brush head is located about the front surface of the body member and is operationally connected to the first motor of the first motor assembly such that the first brush head rotates in response to output of the first motor while a second brush head is located about the front surface of the body member and is operationally connected to the second motor of the second motor assembly such that the second brush head rotates in response to output of the second motor. A first lever of the first suction handle applies suction to a first suction member of the first suction handle and the first lever is accessible through a first opening located on the body member while a second lever of the second suction handle applies suction to a second suction member of the second suction handle and the second lever is accessible through a second opening located on the body member. A series of additional openings is located on the body member. The front surface is symmetrical about a vertical midline extending between the top and the bottom recognizing that the screw holes do not figure into this symmetry.

BRIEF DESCRIPTION OF THE DRAWINGS

Similar reference numerals refer to similar parts throughout the several views of the drawings.

DESCRIPTION OF THE PREFERRED EMBODIMENT

Figure 1:
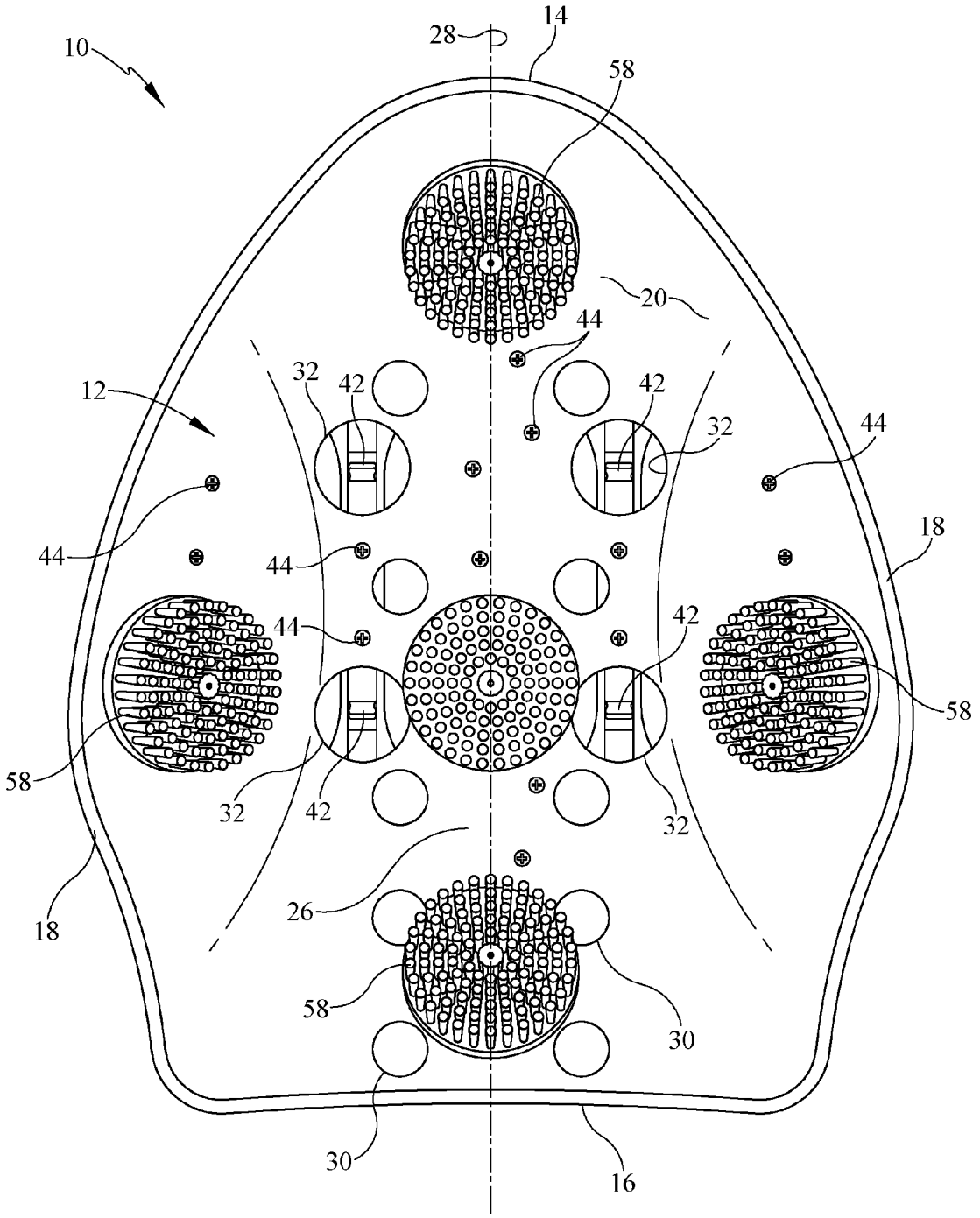
FIG. 1 is front elevation view of the back scrubbing system attachable to a wall of the present invention.
Figure 2:
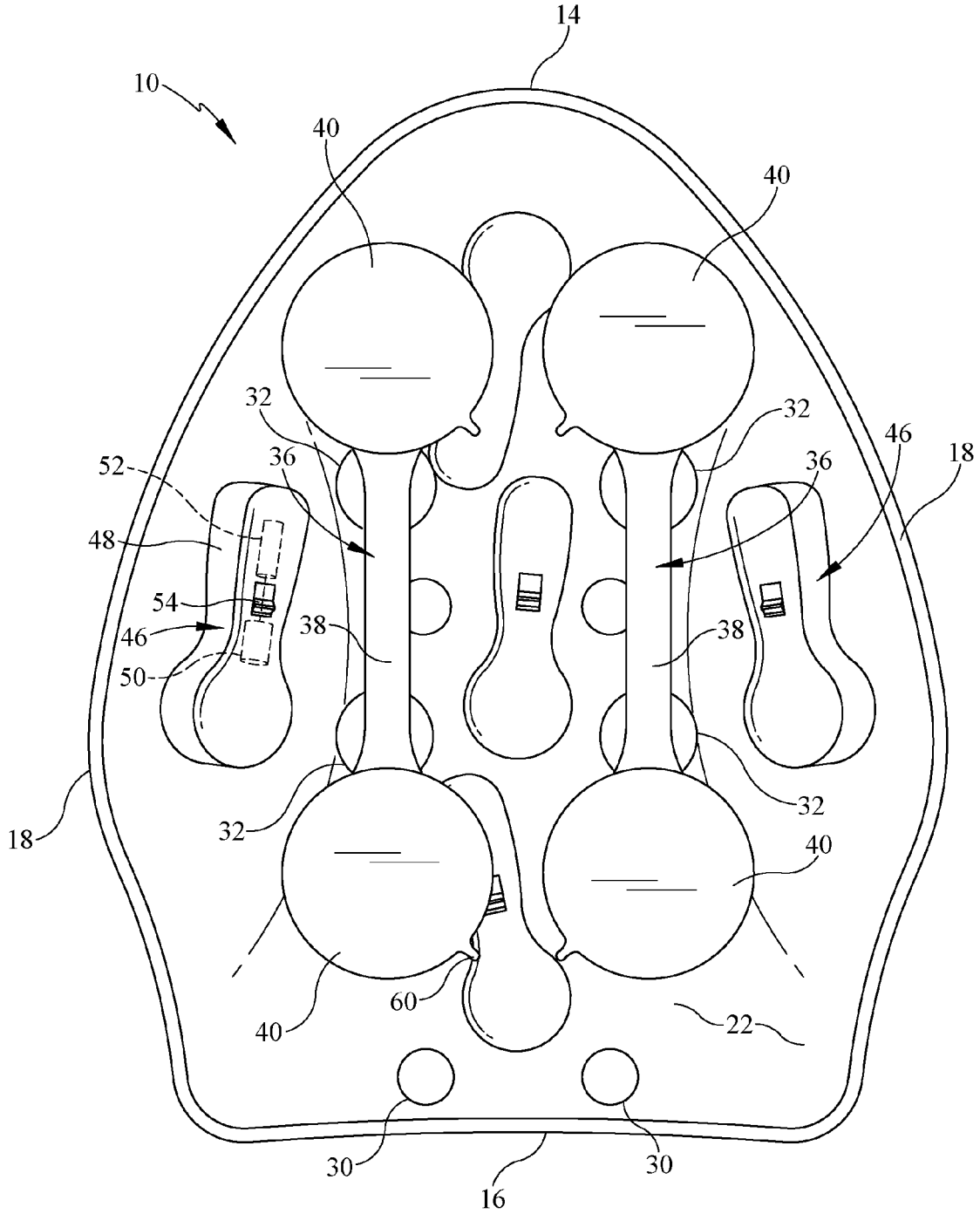
FIG. 2 is a rear elevation view of the back scrubbing system attachable to a wall.
Figure 3:
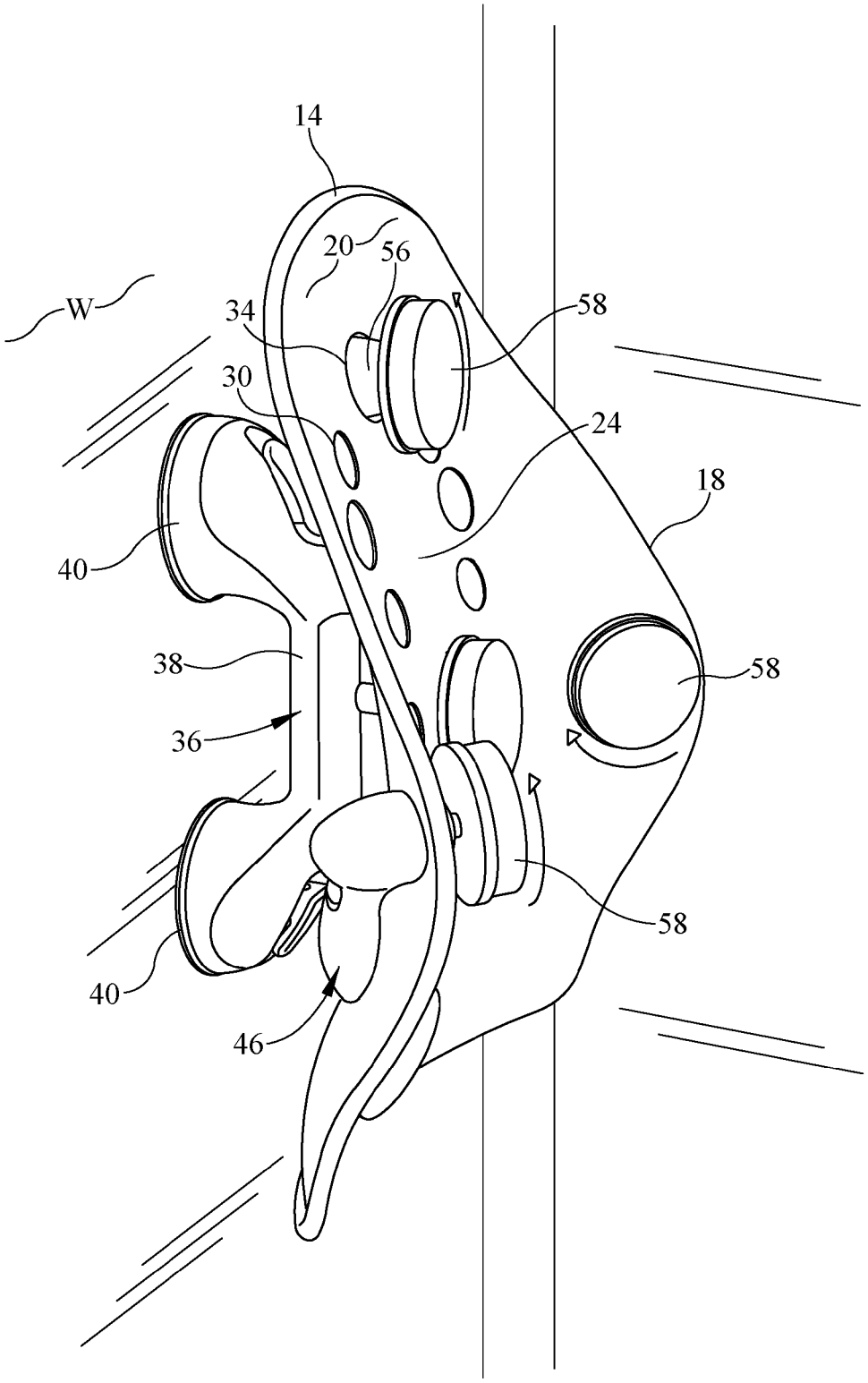
FIG. 3 is an environmental view of the back scrubbing system attachable to a wall attached to a wall surface.

Referring now to the drawings, it is seen that the motorized scrubbing system attachable to a wall surface of the present invention, generally denoted by reference numeral 10, is comprised of a body member 12 that has a top 14, a bottom 16, a pair of sides 18, a front surface 20, and a rear surface 22. As seen, the front surface 20 of the body member 12 is contoured to approximate the curvature of a typical human back (not illustrated). Specifically, extending between the top 14 and the bottom 16 is a channel 24 that curves upwardly in proceeding from the top 14 to the bottom 16, reaching a crest 26 medially between the top 14 and the bottom 16, then curving back downwardly to the bottom 16. The very top of the channel 24, that is, the very end portion of the channel 24 proximate the top 14 may flatten out. All curvatures of the front surface 20 are gradual in conformity to the natural curvature of a typical human back. The body member 12 is substantially symmetrical about either side of a vertical midline 28 passing through the channel 24 between the top 14 and the bottom 16 (this symmetry is not defeated by various screw holes having screws therein, the various screws discussed below). The body member 12 is made from an appropriate lightweight and sturdy material such as plastic. The body member 12 is formed as a single integral and possibly monolithic unit.

As seen, a series of first openings 30 is located within the body member 12, substantially, possibly even exclusively within the channel 24, although as these first openings 30 help channel water (discussed below) as well reduce overall weight of the device, additional first openings may be located on the wings of the channel 24, the wings being the side portions of the channel that rise to the sides 18. Two pairs of second openings 32 are located within the body member 12, one pair of second openings 32 each on either side of the midline 28, and a series of third openings 34 is located within the body member 12.

Attached to the rear surface 22 of the body member 12 is a pair of suction handles 36, one suction handle 36 each on either side of the midline 28. Each suction handle 36, which may be of any appropriate design known in the art, has a handle member 38 and one or advantageously as shown, two suction members 40 attached to the handle member 38 and a suction apply lever 42 located on the handle member 38. Each suction handle 36 is positioned so that its suction apply levers 42 are accessible through a respective one of the second openings 32. Attachment of each suction handle 36 to the rear surface 22 of the body member 12 is in any appropriate manner, such as by passing screws 44 through the body member 12 into appropriate screw bosses (not illustrated) on the suction handle 36.

A series of motorized brush assemblies 46 is attached to the rear surface 22 of the body member 12 in spaced apart formation. Each motorized brush assembly 46 is comprised of a housing 48 holding a motor 50 therein as well as a battery 52 to power the motor 50 and one or more control switches 54 to control operation of the motor 50. The control switches 54 may be push button, toggle, control knob, etc., as is well known in the art of control switches. Output of the motor 50 is translated into a shaft 56 coupled to the motor 50 with the shaft 56 passing through one of the third openings 34 on the body member 12. Located on the end of the shaft 56 is brush head 58 of any desired configuration, each brush head 58 may be substantially similar to the others or various brush heads can be used in a single unit of the motorized scrubbing system attachable to a wall surface 10. Advantageously, removal of a brush head 58 from the shaft 56 and placing a replacement brush head 58 thereon, is relatively quick and straightforward. Operation of the motor 50 causes rotation of the shaft 56 which also rotates its brush head 58. The motor 50 may be configured in multiple ways so that the motor may be a simple one speed unidirectional motor so that the shaft 56 rotates at a single speed in a single direction of rotation, or the motor may be multispeed, or the motor may also be bidirectional with or without multiple speeds. If the motor is bidirectional, the direction of output of the motor and thus direction of rotation of the shaft 58 may be controlled via the one or more control switches 54, or may be automated so the shaft 56 rotates in one direction for a given amount of time and upon expiration of this time, automatically changes direction of rotation. The amount of time between change of direction of rotation may be preset or may be set by a user via the one or more control switches 54, which amount of time may be very rapid so that the shaft 56 changes direction of rotation very quickly so that the brush head 58 gives a pulsating feel. The battery 52 may be a changeable battery so that once the battery no longer has stored electricity, the housing 48 is opened in appropriate fashion, the old battery is removed and replaced with a fresh battery. Alternately, the battery 52 may be rechargeable within the housing 48 via an appropriate battery charger (not illustrated) as is well known in the art of internal battery charging. In either configuration, when the motorized brush assembly 46 is ready for operation, the housing 48 is appropriately sealed against internal moisture penetration in order to protect the motor 50 and the battery 52. Attachment of each motorized brush assembly 46 to the rear surface 22 of the body member 12 is in any appropriate manner, such as by passing screws 44 through the body member 12 into appropriate screw bosses (not illustrated) on the motorized brush assembly 46.

It is expressly recognized that the various motors may be controlled from a single control switch or set of switches located remote of each individual motorized brush assembly and attached to the body member 12 at an appropriate location and electrically connected to each motor in appropriate fashion, or such remote control switches may be wirelessly connected to each motor in any appropriate manner via an appropriate controller (such as a fob having a transmitter and each motor being connected to a corresponding receiver).

In order to use motorized scrubbing system attachable to a wall surface 10 of the present invention, each motor 50 is activated via its control switch 54 and the motorized scrubbing system attachable to a wall surface 10 is attached to a relatively flat surface of a bathing enclosure such as the illustrated wall W of a shower enclosure. The motorized scrubbing system attachable to a wall surface 10 is positioned so that each suction member 40 is positioned against the wall W so as to be able to suction attach thereto (no holes or other similar features at the area of attachment of the wall). Each suction member 40 is suction attached to the wall by articulating its suction apply lever 42 in the usual way through its second opening 32. Once all suction members 40 are appropriately attached, the device is used by having the rotating brush heads 58 brush the back (or any other desired body surface of the user). The first openings 28 and the third openings 32 and to some extent the second openings help guide some water that flows through the channel 24 of the body member 12. When use of the motorized scrubbing system attachable to a wall surface 10 is no longer desired, the suction of each suction member 40 is released via counter-rotation of the suction apply lever 42—and possibly lifting the suction member 40 from the wall W via the small pull tab 60 located on the suction member 40, the device is detached from the wall W, the motors 50 deenergized, and the device stored as desired. If the motors 50 can be deenergized without removal of the device from the wall W, the device may stay attached, however, a user runs the risk of the suction releasing on one or more of the suction members 40 and the device falling from the wall W possibly damaging the device or the surface upon which the device lands.

While the invention has been particularly shown and described with reference to an embodiment thereof, it will be appreciated by those skilled in the art that various changes in form and detail may be made without departing from the spirit and scope of the invention.

I claim:

1. A motorized scrubbing system comprising:

a body member having a front surface and a rear surface such that the front surface is contoured to match a contour of a human back;

attachment means for attaching the body member to a mount surface wherein the attachment means comprises a suction handle attached to the rear surface of the body member and a lever of the suction handle applies suction to a suction member of the suction handle and the lever is accessible through an opening located on the body member;

a motor assembly attached to the rear surface of the body member, the motor assembly having a motor therein; and a brush head located about the front surface of the body member and operationally connected to the motor of the motor assembly such that the brush head rotates in response to output of the motor.

2. The motorized scrubbing system as in claim 1 further comprising a series of openings located on the body member.

3. The motorized scrubbing system as in claim 1 wherein the front surface is symmetrical about a vertical midline extending between a top and a bottom of the body member.

4. The motorized scrubbing system as in claim 3 further comprising a series of openings located on the body member.

5. A motorized scrubbing system comprising:

a body member having a top and a bottom joined by a pair of opposing sides and having a front surface and a rear surface such that the front surface is contoured by forming a channel between the top and the bottom such that the channel rises upwardly in the front surface facing direction in proceeding from the top toward the bottom, reaching a medially disposed crest between the top and the bottom, then curving downwardly to the bottom;

attachment means for attaching the body member to a mount surface;

a motor assembly attached to the rear surface of the body member, the motor assembly having a motor therein; and a brush head located about the front surface of the body member and operationally connected to the motor of the motor assembly such that the brush head rotates in response to output of the motor.

6. The motorized scrubbing system as in claim 5 wherein the attachment means comprises a suction handle attached to the rear surface of the body member.

7. The motorized scrubbing system as in claim 6 wherein a lever of the suction handle applies suction to a suction member of the suction handle and the lever is accessible through an opening located on the body member.

8. The motorized scrubbing system as in claim 5 wherein the front surface is symmetrical about a vertical midline extending between the top and the bottom.

9. A motorized scrubbing system comprising:

a body member having a top and a bottom joined by a pair of opposing sides and having a front surface and a rear surface such that the front surface is contoured by forming a channel between the top and the bottom such that the channel rises upwardly in the front surface facing direction in proceeding from the top toward the bottom, reaching a medially disposed crest between the top and the bottom, then curving downwardly to the bottom;

a first suction handle attached to the rear surface of the body member;

a second suction handle attached to the rear surface of the body member;

a first motor assembly attached to the rear surface of the body member, the first motor assembly having a first motor therein;

a first brush head located about the front surface of the body member and operationally connected to the first motor of the first motor assembly such that the first brush head rotates in response to output of the first motor;

a second motor assembly attached to the rear surface of the body member, the second motor assembly having a second motor therein; and a second brush head located about the front surface of the body member and operationally connected to the second motor of the second motor assembly such that the second brush head rotates in response to output of the second motor.

10. The motorized scrubbing system as in claim 9 wherein a first lever of the first suction handle applies suction to a first suction member of the first suction handle and the first lever is accessible through a first opening located on the body member and a second lever of the second suction handle applies suction to a second suction member of the second suction handle and the second lever is accessible through a second opening located on the body member.

11. The motorized scrubbing system as in claim 9 further comprising a series of openings located on the body member.

12. The motorized scrubbing system as in claim 9 wherein the front surface is symmetrical about a vertical midline extending between the top and the bottom.

* * * * *